US010785589B2

(12) United States Patent
Tammi et al.

(10) Patent No.: US 10,785,589 B2
(45) Date of Patent: Sep. 22, 2020

(54) TWO STAGE AUDIO FOCUS FOR SPATIAL AUDIO PROCESSING

(71) Applicant: NOKIA TECHNOLOGIES OY, Espoo (FI)

(72) Inventors: Mikko Tammi, Tampere (FI); Toni Mäkinen, Pirkkala (FI); Jussi Virolainen, Espoo (FI); Mikko Heikkinen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/486,176

(22) PCT Filed: Jan. 24, 2018

(86) PCT No.: PCT/FI2018/050057

§ 371 (c)(1),
(2) Date: Aug. 15, 2019

(87) PCT Pub. No.: WO2018/154175

PCT Pub. Date: Aug. 30, 2018

(65) Prior Publication Data

US 2019/0394606 A1 Dec. 26, 2019

(30) Foreign Application Priority Data

Feb. 17, 2017 (GB) ..... 1702578.4

(51) Int. Cl.
*H04S 7/00* (2006.01)
*H04R 3/00* (2006.01)
(Continued)

(52) U.S. Cl.
CPC ..... *H04S 7/303* (2013.01); *H04R 1/406* (2013.01); *H04R 3/005* (2013.01); *H04R 5/027* (2013.01);
(Continued)

(58) Field of Classification Search
CPC .. H04S 7/303; H04S 2400/01; H04S 2400/15; H04R 1/406; H04R 3/005;
(Continued)

(56) References Cited

U.S. PATENT DOCUMENTS 8,374,365 B2 2/2013 Goodwin et al.
8,891,797 B2 11/2014 Thiergart et al.
(Continued)

FOREIGN PATENT DOCUMENTS

WO WO 2007/078254 A2 7/2007
WO WO 2014/076058 A1 5/2014
WO WO 2017/005977 A1 1/2017

OTHER PUBLICATIONS

International Search Report and Written Opinion for Application No. PCT/FI2018/050057 dated Jun. 13, 2018, 17 pages.
(Continued)

*Primary Examiner* — Mark Fischer
(74) *Attorney, Agent, or Firm* — Alston & Bird LLP

(57) ABSTRACT

Apparatus comprising one or more processors configured to: receive at least two microphone audio signals (101) for audio signal processing wherein the audio signal processing comprises at least a spatial audio signal processing (303) and beamforming processing (305); determine spatial information (304) based on the audio signal processing associated with the at least two microphone audio signals; determine focus information (308) for the beamforming processing associated with the at least two microphone audio signals; and apply a spatial filter (307) in order to synthesize at least one spatially processed audio signal (312) based on the at least one beamformed audio signal from the at least two microphone audio signals (101), the spatial information (304) and the focus information (308) in such a way that the spatial filter (307), the at least one beamformed audio signal (306), the spatial information (304) and the focus information (308) are configured to be used to spatially synthesize (307) the at least one spatially processed audio signal (312).

20 Claims, 9 Drawing Sheets

(51) Int. Cl.
*H04R 5/027* (2006.01)
*H04R 1/40* (2006.01)

(52) U.S. Cl.
CPC .... *H04R 2201/401* (2013.01); *H04R 2203/12* (2013.01); *H04R 2430/20* (2013.01); *H04S 2400/01* (2013.01); *H04S 2400/15* (2013.01)

(58) Field of Classification Search
CPC ..... H04R 5/027; H04R 2201/401; H04R 2203/12; H04R 2430/20
See application file for complete search history.

(56) References Cited

U.S. PATENT DOCUMENTS

| | | | |
|---|---|---|---|
| 8,934,640 | B2 | 1/2015 | Goodwin |
| 2009/0252356 | A1 | 10/2009 | Goodwin et al. |
| 2012/0128174 | A1 | 5/2012 | Tammi et al. |
| 2013/0044884 | A1 | 2/2013 | Tammi et al. |
| 2014/0086414 | A1 | 3/2014 | Vilermo et al. |
| 2014/0105416 | A1 | 4/2014 | Huttunen et al. |
| 2015/0054943 | A1 | 2/2015 | Zad Issa et al. |
| 2015/0248889 | A1 | 9/2015 | Dickins et al. |
| 2015/0296319 | A1 | 10/2015 | Shenoy et al. |
| 2016/0044410 | A1 | 2/2016 | Makinen et al. |
| 2016/0182799 | A1 | 6/2016 | Laaksonen et al. |
| 2016/0299738 | A1 | 10/2016 | Makinen et al. |

OTHER PUBLICATIONS

Adel, H. et al., *Beamforming Techniques for Multichannel Audio signal Separation*, JDCTA: International Journal of Digital Content Technology and Its Application, vol. 6, No. 20 (2012) 9 pages.

Delikaris-Manias, S. et al., *Signal-Dependent Spatial Filtering Based on Weighted-Orthogonal Beamformers in the Spherical Harmonic Domain*, IEEE/ACM Transactions on Audio, Speech, and Language Processing, vol. 24, No. 9 (Sep. 2016) 1507-1519.

Office Action for Korean Application No. 2019-7026954 dated May 27, 2020, 9 pages.

TWO STAGE AUDIO FOCUS FOR SPATIAL AUDIO PROCESSING

CROSS-REFERENCE TO RELATED APPLICATIONS

The present application is a national phase entry of International Application No. PCT/FI2018/050057, filed Jan. 24, 2018, which claims priority to GB Application No. 1702578.4, filed Feb. 17, 2017, the contents of which are incorporated herein by reference in their entirety.

FIELD

The present application relates to apparatus and methods for two stage audio focus for spatial audio processing. In some situations the two stage audio focus for spatial audio processing is implemented in separate devices.

BACKGROUND

Audio events can be captured efficiently by using multiple microphones in an array. However, it is often difficult to convert captured signals into a form that can be experienced as if being present in the actual recording situation. Particularly, the spatial representation is lacking, i.e. the listener cannot sense the directions of the sound sources (or the ambience around the listener) identically to the original event.

Spatial audio playback systems, such as commonly used 5.1 channel setup or alternative binaural signal with headphone listening, can be applied for representing sound sources in different directions. They are thus suitable for representing spatial events captured with multi-microphone system. Efficient methods for converting multi-microphone capture into spatial signals have been introduced previously.

Audio focus technologies can be used to focus audio capture into a selected direction. This may be implemented where there are many sound sources around a capturing device and only sound sources in one direction are of particular interest. This may be a typical situation for example in a concert where any interesting content is typically in front of the device and there are disturbing sound sources in the audience around the device.

There are proposed solutions for applying audio focus for multi-microphone capture and rendering the output signal into preferred spatial output format (5.1, binaural etc.). However these proposed solutions are currently unable to provide all of the following features at the same time:

- The ability to capture audio with a user-selected audio focus mode (focus direction, strength of focus etc.) to provide to the user control of direction and/or audio source considered important.
- Signal delivery or storage at low bit rate. Bit rate is mainly characterized by number of submitted audio channels.
- Ability to select a spatial format of the synthesis stage output. This enables playback of the audio with different playback devices such as headphones or home theatre.
- Support for head tracking. This is particularly important in VR formats with 3D video.
- Excellent spatial audio quality. Without good spatial audio quality for example VR experience cannot be realistic.

SUMMARY

There is provided according to a first aspect an apparatus comprising one or more processors configured to: receive at least two microphone audio signals for audio signal processing wherein the audio signal processing comprises at least spatial audio signal processing configured to output spatial information and beamforming processing configured to output focus information and at least one beamformed audio signal; determine spatial information based on the spatial audio signal processing associated with the at least two microphone audio signals; determine focus information and at least one beamformed audio signal for the beamforming processing associated with the at least two microphone audio signals; and apply a spatial filter to the at least one beamformed audio signal in order to synthesize at least one focused spatially processed audio signal based on the at least one beamformed audio signal from the at least two microphone audio signals, the spatial information and the focus information in such a way that the spatial filter, the at least one beamformed audio signal, the spatial information and the focus information are configured to be used to spatially synthesize the at least one focused spatially processed audio signal.

The one or more processors may be configured to generate a combined metadata signal from combining the spatial information and the focus information.

According to a second aspect there is provided an apparatus comprising one or more processors configured to: spatially synthesize at least one spatial audio signal from at least one beamformed audio signal and spatial metadata information, wherein the at least one beamformed audio signal is itself generated from a beamforming processing associated with at least two microphone audio signals and the spatial metadata information is based on audio signal processing associated with the at least two microphone audio signals; and spatially filter the at least one spatial audio signal based on focus information for the beamforming processing associated with the at least two microphone audio signals to provide at least one focused spatially processed audio signal.

The one or more processors may be further configured to: spatial audio signal process the at least two microphone audio signals to determine the spatial information based on the audio signal processing associated with the at least two microphone audio signals; and determine the focus information for the beamforming processing and beamform process the at least two microphone audio signals to produce the at least one beamformed audio signal.

The apparatus may be configured to receive an audio output selection indicator defining an output channel arrangement and wherein the apparatus configured to spatially synthesize at least one spatial audio signal may be further configured to generate the at least one spatial audio signal in a format based on the audio output selection indicator.

The apparatus may be configured to receive an audio filter selection indicator defining a spatial filtering and wherein the apparatus configured to spatially filter the at least one spatial audio signal may be further configured to spatially filter the at least one spatial audio signal based on at least one focus filter parameter associated with the audio filter selection indicator, wherein the at least one filter parameter may comprise at least one of: at least one spatial focus filter parameter, the spatial focus filter parameter defining at least one of a focus direction in at least one of azimuth and/or elevation and a focus sector in a azimuth width and/or elevation height; at least one frequency focus filter parameter, the frequency focus filter parameter defining at least one frequency band of which the at least one spatial audio signal are focussed; at least one dampening focus filter parameter, the dampening focus filter defining a strength of a dampening focus effect on the at least one spatial audio signal; at least one gain focus filter parameter, the gain focus filter defining a strength of a focus effect on the at least one spatial audio signal; and a focus bypass filter parameter, the focus bypass filter parameter defining whether to implement or bypass the spatial filter of the at least one spatial audio signal.

The audio filter selection indicator may be provided by a head tracker input.

The focus information may comprise a steering mode indicator configured to enable the processing of the audio filter selection indicator provided by the head tracker input.

The apparatus configured to spatially filter the at least one spatial audio signal based on focus information based on the beamforming processing associated with the at least two microphone audio signals to provide at least one focused spatially processed audio signal may be further configured to spatially filter the at least one spatial audio signal to at least partly to cancel an effect of the beamforming processing associated with at least two microphone audio signals.

The apparatus configured to spatially filter the at least one spatial audio signal based on focus information for the beamforming processing associated with the at least two microphone audio signals to provide at least one focused spatially processed audio signal may be further configured to spatially filter only frequency bands that are not significantly affected by the beamforming processing associated with at least two microphone audio signals.

The apparatus configured to spatially filter the at least one spatial audio signal based on focus information for the beamforming processing associated with the at least two microphone audio signals to provide at least one focused spatially processed audio signal may be configured to spatially filter the at least one spatial audio signal in a direction indicated within the focus information.

The spatial information based on the audio signal processing associated with the at least two microphone audio signals and/or the focus information for the beamforming processing associated with the at least two microphone audio signals may comprise a frequency band indicator configured to determine which frequency bands of the at least one spatial audio signal may be processed by the beamforming processing.

The apparatus configured to produce at least one beamformed audio signal from the beamforming processing associated with the at least two microphone audio signals may be configured to produce at least two beamformed stereo audio signals.

The apparatus configured to produce at least one beamformed audio signal from the beamforming processing associated with the at least two microphone audio signals may be configured to: determine one of two predetermined beamform directions; and beamform the at least two microphone audio signals in the one of the two predetermined beamform directions.

The one or more processors may be further configured to receive the at least two microphone audio signals from a microphone array.

According to a third aspect there is provided a method comprising: receiving at least two microphone audio signals for audio signal processing wherein the audio signal processing comprises at least spatial audio signal processing configured to output spatial information and beamforming processing configured to output focus information and at least one beamformed audio signal; determining spatial information based on the spatial audio signal processing associated with the at least two microphone audio signals; determining focus information and at least one beamformed audio signal for the beamforming processing associated with the at least two microphone audio signals; and applying a spatial filter to the at least one beamformed audio signal in order to synthesize at least one focused spatially processed audio signal based on the at least one beamformed audio signal from the at least two microphone audio signals, the spatial information and the focus information in such a way that the spatial filter, the at least one beamformed audio signal, the spatial information and the focus information are configured to be used to spatially synthesize the at least one focused spatially processed audio signal.

The method may further comprise generating a combined metadata signal from combining the spatial information and the focus information.

According to a fourth aspect there is provided a method comprising: spatially synthesizing at least one spatial audio signal from at least one beamformed audio signal and spatial metadata information, wherein the at least one beamformed audio signal is itself generated from a beamforming processing associated with at least two microphone audio signals and the spatial metadata information is based on audio signal processing associated with the at least two microphone audio signals; and spatially filtering the at least one spatial audio signal based on focus information for the beamforming processing associated with the at least two microphone audio signals to provide at least one focused spatially processed audio signal.

The method may further comprise: spatial audio signal processing the at least two microphone audio signals to determine the spatial information based on the audio signal processing associated with the at least two microphone audio signals; and determining the focus information for the beamforming processing and beamform processing the at least two microphone audio signals to produce the at least one beamformed audio signal.

The method may further comprise receiving an audio output selection indicator defining an output channel arrangement, wherein spatially synthesizing at least one spatial audio signal may comprise generating the at least one spatial audio signal in a format based on the audio output selection indicator.

The method may comprise receiving an audio filter selection indicator defining a spatial filtering, and wherein spatially filtering the at least one spatial audio signal may comprise spatially filtering the at least one spatial audio signal based on at least one focus filter parameter associated with the audio filter selection indicator, wherein the at least one filter parameter may comprise at least one of: at least one spatial focus filter parameter, the spatial focus filter parameter defining at least one of a focus direction in at least one of azimuth and/or elevation and a focus sector in a azimuth width and/or elevation height; at least one frequency focus filter parameter, the frequency focus filter parameter defining at least one frequency band of which the at least one spatial audio signal are focussed; at least one dampening focus filter parameter, the dampening focus filter defining a strength of a dampening focus effect on the at least one spatial audio signal; at least one gain focus filter parameter, the gain focus filter defining a strength of a focus effect on the at least one spatial audio signal; and a focus bypass filter parameter, the focus bypass filter parameter defining whether to implement or bypass the spatial filter of the at least one spatial audio signal.

The method may further comprise receiving the audio filter selection indicator from a head tracker.

The focus information may comprise a steering mode indicator configured to enable the processing of the audio filter selection indicator.

Spatially filtering the at least one spatial audio signal based on focus information based on the beamforming processing associated with the at least two microphone audio signals to provide at least one focused spatially processed audio signal may comprise spatially filtering the at least one spatial audio signal to at least partly to cancel an effect of the beamforming processing associated with at least two microphone audio signals.

Spatially filtering the at least one spatial audio signal based on focus information for the beamforming processing associated with the at least two microphone audio signals to provide at least one focused spatially processed audio signal may comprise spatially filtering only frequency bands that are not significantly affected by the beamforming processing associated with at least two microphone audio signals.

Spatially filtering the at least one spatial audio signal based on focus information for the beamforming processing associated with the at least two microphone audio signals to provide at least one focused spatially processed audio signal may comprise spatially filtering the at least one spatial audio signal in a direction indicated within the focus information.

The spatial information based on the audio signal processing associated with the at least two microphone audio signals and/or the focus information for the beamforming processing associated with the at least two microphone audio signals may comprise a frequency band indicator determining which frequency bands of the at least one spatial audio signal are processed by the beamforming processing.

Producing at least one beamformed audio signal from the beamforming processing associated with the at least two microphone audio signals may comprise producing at least two beamformed stereo audio signals.

Producing at least one beamformed audio signal from the beamforming processing associated with the at least two microphone audio signals may comprise: determining one of two predetermined beamform directions; and beamforming the at least two microphone audio signals in the one of the two predetermined beamform directions.

The method may further comprise receiving the at least two microphone audio signals from a microphone array.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective two stage audio focus (or defocusing) systems. In the following examples, audio signals and audio capture signals are described. However it would be appreciated that in some embodiments the apparatus may be part of any suitable electronic device or apparatus configured to capture an audio signal or receive the audio signals and other information signals.

Figure 1:
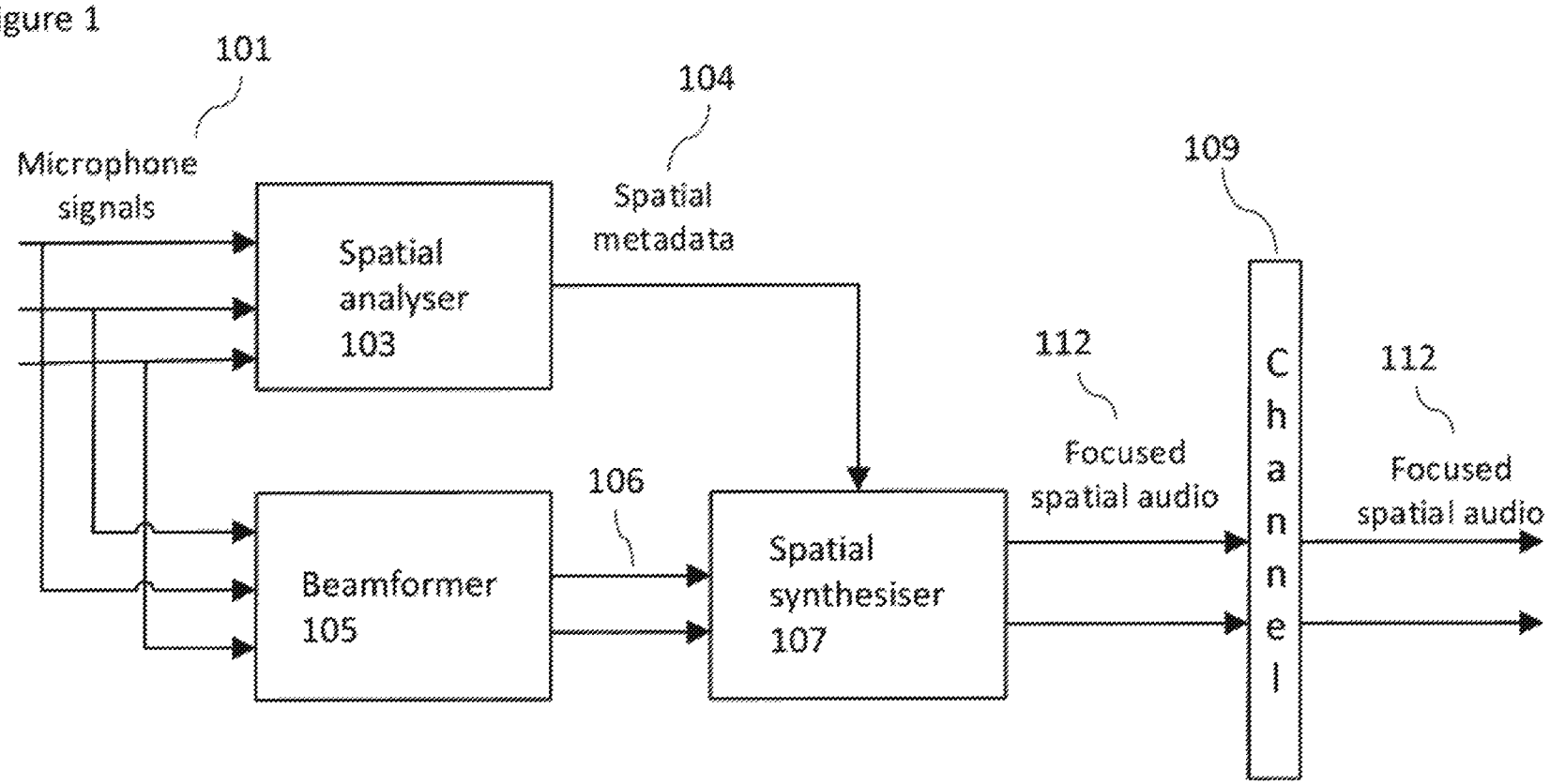
FIG. 1 shows an existing audio focus system.

The problems associated with current audio focus methods can be shown with respect to a current audio focus system shown in FIG. 1. FIG. 1 thus shows an audio signal processing system which receives the inputs from at least two microphones (in FIG. 1 and the following figures three microphone audio signals are shown as an example microphone audio signal input however any suitable number of microphone audio signals may be used). The microphone audio signals 101 are passed to a spatial analyser 103 and to a beamformer 105.

The audio focus system shown in FIG. 1 may be independent of the audio signal capture apparatus which comprises the microphones used to capture the microphone audio signals and as such is independent from the capture apparatus form factor. In other words there may also be a great variation on the number, type and arrangement of microphones in the system.

The system shown in FIG. 1 shows a beamformer 105 configured to receive the microphone audio signals 101. The beamformer 105 may be configured to apply a beamforming operation on the microphone audio signals and to generate a stereo audio signal output reflecting a left and right channel output based on the beamformed microphone audio signals. The beamforming operations are used to emphasize signals arriving from at least one selected focus direction. This may further be considered to be an operation which attenuates sounds arriving from 'other' directions. Beamforming methods such as is presented for example in US-20140105416. The stereo audio signal output 106 may be passed to a spatial synthesiser 107.

The system shown in FIG. 1 further shows a spatial analyser 103 configured to receive the microphone audio signals 101. The spatial analyser 103 may be configured to analyse the directions of dominating sound sources for every time-frequency band. This information or spatial metadata 104 may then be passed to a spatial synthesiser 107.

The system shown in FIG. 1 further shows the generation of spatial synthesis and furthermore the application of a spatial filtering operation on the stereo audio signals 106 following the beamforming. The system shown in FIG. 1 furthermore shows a spatial synthesiser 107 configured to receive the spatial metadata 104 and the stereo audio signals 106. The spatial synthesiser 107 may for example apply a spatial filtering to further emphasize sound sources in a direction of interest. This is done by processing the results of the analysis stage performed in the spatial analyser 103 in the synthesiser to amplify sources in a preferred direction and attenuating other sources. Spatial synthesis and filtering methods are presented for example in US-20120128174, US-20130044884 and US-20160299738. Spatial synthesis can be applied to any suitable spatial audio formats such as stereo (binaural) audio or 5.1 multichannel audio.

The strength of focus effect which can be achieved with beamforming using microphone audio signals from a modern mobile device is typically about 10 dB. With spatial filtering an approximately similar effect can be reached. Thus the overall focus effect can be in practice double the effect of beamforming or spatial filtering used individually. However due to the physical limitations of modern mobile devices regarding microphone positions and their low number (usually 3) of microphones, beamforming performance alone cannot in practice provide a good enough focus effect over the whole audio spectrum. This is the driving force for the application of additional spatial filtering.

The two-phase approach combines the strengths of both beamforming and spatial filtering. These are that beamforming does not cause artefacts or notably degrade the audible audio quality (in principle it only delays and/or filters one microphone signal and sums it with another one), and moderate spatial filtering effects can be achieved with only minor (or even no) audible artefacts. The spatial filtering may be independently implemented to the beamforming as it only filters (amplifies/attenuates) the signal based on the direction estimates obtained from the original (not beamed) audio signals.

Both of the methods can be implemented independently, when they provide a milder, yet clearly audible, focus effect. This milder focus may be sufficient for certain situations, especially when only a single dominant sound source exists.

Too aggressive amplification on the spatial filtering phase can lead to the audio quality degrading and a two-phase approach prevents this quality drop.

In the audio focus system shown in FIG. 1 the synthesized audio signal 112 can then be coded with a selected audio codec and stored or delivered through a channel 109 to receiving end as any audio signal. However this system is problematic for many reasons. For example the selected playback format has to be decided at the capture side and cannot be selected by the receiver and thus the receiver is unable to select an optimised playback format. Furthermore the encoded synthesized audio signal bit rate can be high, especially for multichannel audio signal formats. Furthermore such a system does not permit support for head tracking or similar inputs for controlling the focus effect.

Figure 2:
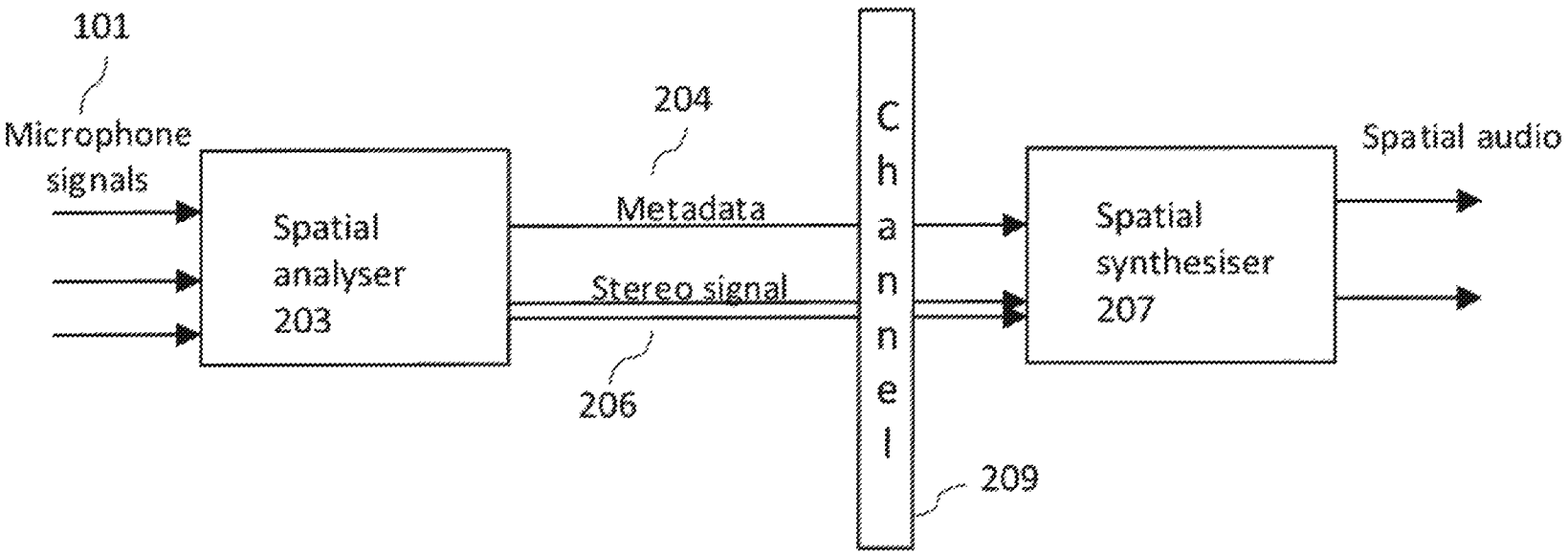
FIG. 2 shows schematically an existing spatial audio format generator.

An efficient spatial audio format system for delivering spatial audio is described with respect to FIG. 2. This system is described for example in US-20140086414.

The system comprises a spatial analyser 203 configured to receive the microphone audio signals 101. The spatial analyser 203 may be configured to analyse the directions of dominating sound sources for every frequency band. This information or spatial metadata 204 may then be passed to a spatial synthesiser 207 via a channel 209 or stored locally. Furthermore the audio signals 101 are compressed by generating a stereo signal 206, which may be two input microphone audio signals. This compressed stereo signal 206 is also delivered through the channel 209 or stored locally.

The system further comprises a spatial synthesiser 207 which is configured to receive the stereo signal 206 and spatial metadata 204 as an input. The spatial synthesis output can then be implemented into any preferred output audio format. The system produces many benefits including a possibility of low bit rate (only 2 channel audio coding and spatial metadata are required to encode the microphone audio signals). Furthermore as it is possible to select output spatial audio format at the spatial synthesis stage this enables support for several playback devices types (mobile device, home theatre etc.). Also such a system permits head tracking support for binaural signals which would be especially useful for virtual reality/augmented reality or immersive 360 degree videos. Furthermore such as system permits the ability to play back the audio signals as legacy stereo signals, for example where the playback device does not support spatial synthesis processing.

However such as system shown in FIG. 2 has a significant drawback in that the introduced spatial audio format does not as such support audio focusing including both the beamforming and spatial filtering as shown in FIG. 1.

This concept as discussed in the embodiments in detail hereafter is the provision of a system which combines audio focus processing and spatial audio formatting. The embodiments thus show the focus processing aspects divided into two parts such that part of processing is done in capture side and part is done in playback side. In such embodiments as described herein a capture apparatus or device user may be configured to activate a focus functionality and when the focus related processing is applied both at capture and playback side a maximal focus effect is achieved. At the same time all the benefits of the spatial audio format system are maintained.

In the embodiments as described herein the spatial analysis part is always performed at the audio capturing apparatus or device. However the synthesis can be performed either at the same entity or in another device, such as the playback device. This means that an entity playing back the focused audio content does not necessarily have to support the spatial encoding.

Figure 3:
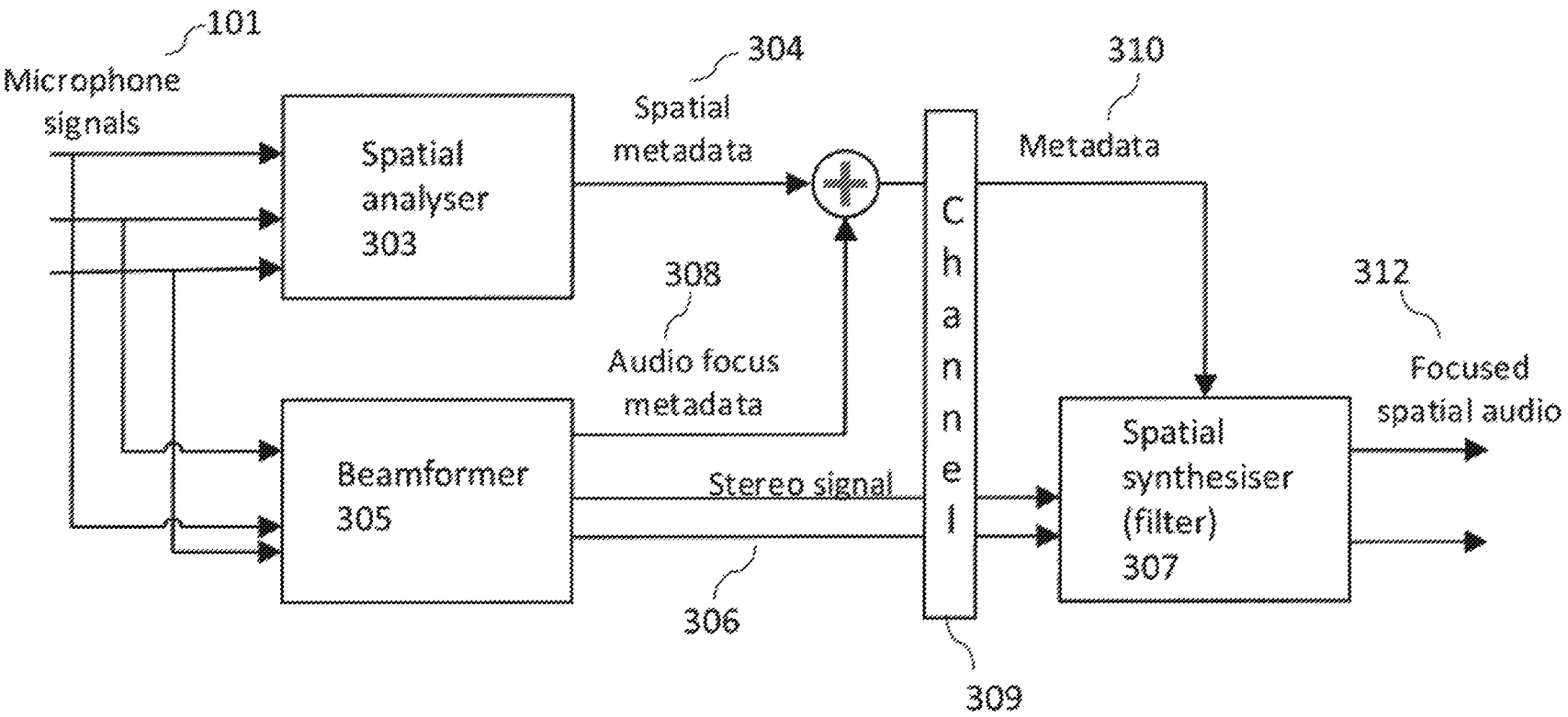
FIG. 3 shows schematically an example two stage audio focus system implementing spatial audio format support according to some embodiments.

With respect to FIG. 3 an example two stage audio focus system implementing spatial audio format support according to some embodiments is shown. In this example the system comprises a capture (and first stage processing) apparatus, a playback (and second stage processing) apparatus, and a suitable communications channel 309 separating the capture and second stage apparatus is shown.

The capture apparatus is shown receiving microphone signals 101. The microphone signals 101 (shown as three microphone signals in FIG. 3 but may be any number equal to or more than two in other embodiments) are input to the spatial analyser 303 and the beamformer 305.

The microphone audio signals may be generated in some embodiments by a directional or omnidirectional microphone array configured to capture an audio signal associated with a sound field represented for example by the sound source(s) and ambient sound. In some embodiments the capture device is implemented within a mobile device/OZO, or any other device with or without cameras. The capture device is thus configured to capture audio signals, which, when rendered to a listener, enables the listener to experience the spatial sound similar to that if they were present in the location of the spatial audio capture device.

The system (the capture apparatus) may comprise a spatial analyser 303 configured to receive the microphone signals 101. The spatial analyser 303 may be configured to analyse the microphone signals to generate spatial metadata 304 or information signals associated with the analysis of the microphone signals.

In some embodiments the spatial analyser 303 may implement spatial audio capture (SPAC) techniques which represent methods for spatial audio capture from microphone arrays to loudspeakers or headphones. Spatial audio capture (SPAC) refers here to techniques that use adaptive time-frequency analysis and processing to provide high perceptual quality spatial audio reproduction from any device equipped with a microphone array, for example, Nokia OZO or a mobile phone. At least 3 microphones are required for SPAC capture in horizontal plane, and at least 4 microphones are required for 3D capture. The term SPAC is used in this document as a generalized term covering any adaptive array signal processing technique providing spatial audio capture. The methods in scope apply the analysis and processing in frequency band signals, since it is a domain that is meaningful for spatial auditory perception. Spatial metadata such as directions of the arriving sounds, and/or ratio or energy parameters determining the directionality or non-directionality of the recorded sound, are dynamically analysed in frequency bands.

One method of spatial audio capture (SPAC) reproduction is Directional Audio Coding (DirAC), which is a method using sound field intensity and energy analysis to provide spatial metadata that enables the high-quality adaptive spatial audio synthesis for loudspeakers or headphones. Another example is harmonic planewave expansion (Harpex), which is a method that can analyze two plane waves simultaneously, which may further improve the spatial precision in certain sound field conditions. A further method is a method intended primarily for mobile phone spatial audio capture, which uses delay and coherence analysis between the microphones to obtain the spatial metadata, and its variant for devices containing more microphones and a shadowing body, such as OZO. Although variants are described in the following examples, any suitable method applied to obtain the spatial metadata can be used. The SPAC idea as such is one where from the microphone signals a set of spatial metadata (such as in frequency bands the directions of the sound, and the relative amount of non-directional sound such as reverberation) is analysed from microphone audio signals, and which enable the adaptive accurate synthesis of the spatial sound.

The use of SPAC methods are also robust for small devices for two reasons: Firstly, they typically use short-time stochastic analysis, which means that the effect of noise is reduced at the estimates. Secondly, they typically are designed for analysing perceptually relevant properties of the sound field, which is the primary interest in spatial audio reproduction. The relevant properties are typically direction(s) of arriving sounds and their energies, and the amount of non-directional ambient energy. The energetic parameters can be expressed in many ways, such as in terms of a direct-to-total ratio parameter, ambience-to-total ratio parameter, or other. The parameters are estimated in frequency bands, because in such a form these parameters are particularly relevant for human spatial hearing. The frequency bands could be Bark bands, equivalent rectangular bands (ERBs), or any other perceptually motivated non-linear scale. Also linear frequency scales are applicable, although in this case it is desirable that the resolution is sufficiently fine to cover also the low frequencies at which the human hearing is most frequency selective.

The spatial analyser in some embodiments comprises a filter-bank. The filter-bank enables time domain microphone audio signals to be transformed into frequency band signals. As such any suitable time to frequency domain transform may be applied to the audio signals. A typical filter-bank which may be implemented in some embodiments is a short-time Fourier transform (STFT), involving an analysis window and FFT. Other suitable transforms in place of the STFT may be a complex-modulated quadrature mirror filter (QMF) bank. The filter-bank may produce complex-valued frequency band signals, indicating the phase and the amplitude of the input signals as a function of time and frequency. The filter bank may be uniform in its frequency resolution which enables highly efficient signal processing structures. However uniform frequency bands may be grouped into a non-linear frequency resolution approximating a spectral resolution of human spatial hearing.

The filter-bank may receive the microphone signals x(m, n'), where m and n' are indices for microphone and time respectively and transform the input signals into the frequency band signals by means of a short time Fourier transform $$X(k,m,n)=F(x(m,n')),$$

where X denotes the transformed frequency band signals, and k denotes the frequency band index, and n denotes the time index.

The spatial analyser may be applied on the frequency band signals (or groups of them) to obtain the spatial metadata. A typical example of the spatial metadata is direction(s) and direct-to-total energy ratio(s) at each frequency interval and at each time frame. For example, it is an option to retrieve the directional parameter based on inter-microphone delay-analysis, which in turn can be performed for example by formulating the cross-correlation of the signals with different delays and finding the maximum correlation. Another method to retrieve the directional parameter is to use the sound field intensity vector analysis, which is the procedure applied in Directional Audio Coding (DirAC).

At the higher frequencies (above spatial aliasing frequency) it is an option to use the device acoustic shadowing for some devices such as OZO to obtain the directional information. The microphone signal energies are typically higher at that side of the device where most of the sound arrives, and thus the energy information can provide an estimate for the directional parameter.

There are many further methods in the field of array signal processing to estimate the direction-of-arrival.

It is also an option to use inter-microphone coherence analysis to estimate the amount of the non-directional ambience at each time-frequency interval (in other words, the energy ratio parameter). The ratio parameter can be estimated also with other methods, such as using a stability measure of the directional parameter, or similar. The specific method applied to obtain the spatial metadata is not of main interest in the present scope.

In this section, one method using delay estimation based on correlation between audio input signal channels is described. In this method the direction of arriving sound is estimated independently for B frequency domain subbands. The idea is to find at least one direction parameter for every subband which may be a direction of an actual sound source, or a direction parameter approximating the combined directionality of multiple sound sources. For example, in some cases the direction parameter may point directly towards a single active source, while in other cases, the direction parameter may, for example, fluctuate approximately in an arc between two active sound sources. In presence of room reflections and reverberation, the direction parameter may fluctuate more. Thus, the direction parameter can be considered a perceptually motivated parameter: Although for example one direction parameter at a time-frequency interval with several active sources may not point towards any of these active sources, it approximates the main directionality of the spatial sound at the recording position. Along with the ratio parameter, this directional information roughly captures the combined perceptual spatial information of the multiple simultaneous active sources. Such analysis is performed each time-frequency interval, and as the result the spatial aspect of the sound is captured in a perceptual sense. The directional parameters fluctuate very rapidly, and express how the sound energy fluctuates through the recording position. This is reproduced for the listener, and the listener's hearing system then gets the spatial perception. In some time-frequency occurrences one source may be very dominant, and the directional estimate points exactly to that direction, but this is not a general case.

The frequency band signal representation is denoted as X(k,m,n) where m is the microphone index, k the frequency band index {k=0, . . . , N−1} and where N is the number of frequency bands of the time-frequency transformed signals. The frequency band signal representation is grouped into B subbands, each of which has a lower frequency band index $k_b^-$ and an upper frequency band index $k_b^+$. The widths of the subbands ($k_b^+-k_b^-+1$) can approximate, for example, the ERB (equivalent rectangular bandwidth) scale or the Bark scale.

The directional analysis may feature the following operations. In this case, we assume a flat mobile device with three microphones. This configuration can provide the analysis of the directional parameter in the horizontal plane, and a ratio parameter, or similar.

First the horizontal direction is estimated with two microphone signals (in this example microphones 2 and 3 being located in the horizontal plane of the capture device at the opposing edges of the device). For the two input microphone audio signals, the time difference between the frequency-band signals in those channels is estimated. The task is to find delay $\tau_b$ that maximizes the correlation between two channels for subband b.

The frequency band signals X(k,m,n) can be shifted $\tau_b$ time domain samples using $$X_{\tau_b}(k, m, n) = X(k, m, n)e^{-j\frac{2\pi f_k \tau_b}{f_s}},$$

Where $f_k$ is the center frequency of band k, and $f_s$ is the sampling rate. The optimal delay for subband b and time index n is then obtained from $$\tau_{b,max}(n) = \max_{\tau_b} \mathrm{Re}\left(\sum_{k=k_b^-}^{k_b^+} X_{\tau_b}(k, 2, n)^* X(k, 3, n)\right), \tau_b \in [-D_{max}, D_{max}]$$

where Re indicates the real part of the result and * denotes complex conjugate, and $D_{max}$ is the maximum delay in samples, which can be a fractional number, and occurs when the sound arrives exactly at the axis determined by the microphone pair. Although an example of delay estimation over one time index n is exemplified above, in some embodiments the estimation of the delay parameter may be performed over several indices n by averaging or adding the estimates also in that axis. For $\tau_b$ the resolution of approximately one sample is for many smart phones satisfactory for the search of the delay. Also other perceptually motivated similarity measures than correlation can be used.

A 'sound source', which is a representation of the audio energy captured by the microphones, thus may be considered to create an event described by an exemplary time-domain function which is received at a microphone for example a second microphone in the array and the same event received by a third microphone. In an ideal scenario, the exemplary time-domain function which is received at the second microphone in the array is simply a time shifted version of the function received at the third microphone. This situation is described as ideal because in reality the two microphones will likely experience different environments for example where their recording of the event could be influenced by constructive or destructive interference or elements that block or enhance sound from the event, etc.

The shift $\tau_b$ indicates how much closer the sound source is to the second microphone than the third microphone (when $\tau_b$ is positive, the sound source is closer to the second microphone than the third microphone). The between −1 and 1 normalized delay can be formulated as $$\frac{\tau_{b,max}}{D_{max}}.$$

Utilizing basic geometry, and assuming that the sound is a plane wave arriving at the horizontal plane, it can be determined that the horizontal angle of the arriving sound is equal to $$\alpha_b = \pm\cos^{-1}\left(\frac{\tau_{b,max}}{D_{max}}\right),$$

Notice that there are two alternatives for the direction of the arriving sound as the exact direction cannot be determined with only two microphones. For example, a source at a mirror-symmetric angle at the front or rear of the device may produce the same inter-microphone delay estimate.

A further microphone, for example a first microphone in an array of three microphones, can then be utilized to define which of the signs (the + or −) is correct. This information can be obtained in some configurations by estimating the delay parameter between a microphone pair having one (e.g. the first microphone) at the rear side of the smart phone, and another (e.g. the second microphone) at the front side of the smart phone. The analysis at this thin axis of the device may be noisy to produce reliable delay estimates. However, the general tendency if the maximum correlation is found at the front side or the rear side of the device may be robust. With this information the ambiguity of the two possible directions can be resolved. Also other methods may be applied for resolving the ambiguity.

The same estimation is repeated for each subband.

An equivalent method can be applied to microphone arrays where there is both 'horizontal' and 'vertical' displacement in order that the azimuth and elevation can be determined. For devices or smartphones with four or more microphones (which are displaced from each other in a plane perpendicular to the directions described above) it may be also possible to perform elevation analysis. In that case, for example, the delay analysis can be formulated first in the horizontal plane and then in the vertical plane. Then, based on the two delay estimates one can find an estimated direction of arrival. For example, one may perform a delay-to-position analysis similar to that in GPS positioning systems. In this case also, there is a directional front-back ambiguity, which is solved for example as described above.

In some embodiments the ratio metadata expressing the relative proportions of non-directional and directional sound may be generated according to the following method:

1) For the microphones with largest mutual distance the maximum-correlation delay value and the corresponding correlation value c is formulated. The correlation value c is a normalized correlation which is 1 for fully correlating signals and 0 for incoherent signals.

2) For each frequency, a diffuse field correlation value ($c_{diff}$) is formulated, depending on the microphone distance. For example, at high frequencies $c_{diff} \approx 0$. For low frequencies it may be non-zero.

3) The correlation value is normalised to find the ratio parameter: $\text{ratio}=(c-c_{diff})/(1-c_{diff})$ The resulting ratio parameter is then truncated between 0 and 1. With such an estimate method:

When $c=1$, then $\text{ratio}=1$.

When $c \leq c_{diff}$, then $\text{ratio}=0$.

When $c_{diff}<c<1$, then $0<\text{ratio}<1$.

The above simple formulation provides an approximation of the ratio parameter. At the extremes (the fully directional and fully non-directional sound field conditions) the estimate is true. The ratio estimate between extremes may have some bias depending on the sound arrival angle. Nevertheless, the above formulation can be demonstrated to be satisfactorily accurate in practice also in these conditions. Other methods to generate the directional and ratio parameters (or other spatial metadata depending on the applied analysis technique) are also applicable.

The aforementioned method in the class of SPAC analysis methods is intended for primarily flat devices such as smart phones: The thin axis of the device is determined suitable only for the binary front-back choice, because more accurate spatial analysis may not be robust at that axis. The spatial metadata is analysed primarily at the longer axes of the device, using the aforementioned delay/correlation analysis, and directional estimation accordingly.

A further method to estimate the spatial metadata is described in the following, providing an example of the practical minimum of two microphone channels. Two directional microphones having different directional patterns may be placed, for example 20 cm apart. Equivalently to the previous method, two possible horizontal directions of arrival can be estimated using the microphone-pair delay analysis. The front-back ambiguity can then be resolved using the microphone directivity: If one of the microphones has more attenuation towards the front, and the other microphone has more attenuation towards the back, the front-back ambiguity can be resolved for example by measuring the maximum energy of the microphone frequency band signals. The ratio parameter can be estimated using correlation analysis between the microphone pair, for example, using a similar method than as described previously.

Clearly, other spatial audio capture methods can also be suitable for obtaining the spatial metadata. In particular, for non-flat devices such as spherical devices, other methods may be more suitable, for example, by enabling higher robustness for the parameter estimation. A well-known example in the literature is Directional Audio Coding (DirAC), which in its typical form comprises of the following steps:

1) A B-format signal is retrieved, which is equivalent to the first order spherical harmonic signal.
2) The sound field intensity vector and the sound field energy are estimated in frequency bands from the B-format signal:
   a. The intensity vector can be obtained using the short-time cross-correlation estimates between the W (zeroth order) signal and the X,Y,Z (first order) signals. The direction-of-arrival is the opposite direction of the sound field intensity vector.
   b. From the absolute value of the sound field intensity and the sound field energy, a diffuseness (i.e., an ambience-to-total ratio) parameter can be estimated. For example, when the length of the intensity vector is zero, the diffuseness parameter is one.

Thus, in one embodiment the spatial analysis according to the DirAC paradigm can be applied to produce the spatial metadata, thus ultimately enabling the synthesis of the spherical harmonic signals. In other words, a directional parameter and a ratio parameter can be estimated by several different methods.

The spatial analyser 303 may this use SPAC analysis to provide perceptually relevant dynamic spatial metadata 304, e.g. the direction(s) and energy ratio(s) in frequency bands.

Furthermore the system (and the capture device) may comprise a beamformer 305 configured to also receive the microphone signals 101. The beamformer 305 is configured to generate a beamformed stereo (or suitable downmix channel) signal 306 output. The beamformed stereo (or suitable downmix channel) signal 306 may be stored or output over the channel 309 to the second stage processing apparatus. The beamformed audio signals may be generated from a weighted sum of delayed or undelayed microphone audio signals. The microphone audio signals may be in the time or the frequency domain. In some embodiments the spatial separation of the microphones which generate the audio signals may be determined and this information used to control the beamformed audio signals generated.

Furthermore the beamformer 305 is configured to output focus information 308 for the beamformer operation. The audio focus information or metadata 308 may for example indicate aspects of the audio focus generated by the beamformer (for example direction, beamwidth, audio frequencies beamformed etc). The audio focus metadata (which is part of the combined metadata) may include for example information such as a focus direction (azimuth and/or elevation angle in degrees), a focus sector width and/or height (in degrees), and a focus gain which defines the strength of the focus effect. Similarly in some embodiments of the metadata may comprise information such as whether or not a steering mode can be applied such that the head tracking is followed or fixed. Other metadata may include indications of which frequency bands can be focused, and the strength of the focus which can be adjusted for different sectors with focus gain parameters defined individually for every band.

In some embodiments the audio focus metadata 308 and audio spatial metadata 304 can be combined, and optionally encoded. The combined metadata 310 signal may be stored or output over the channel 309 to the second stage processing apparatus.

The system, at the playback (second stage) apparatus side is configured to receive the combined metadata 310 and the beamformed stereo audio signal 306. In some embodiments the apparatus comprises a spatial synthesizer 307. The spatial synthesizer 307 can receive the combined metadata 310 and the beamformed stereo audio signal 306 and perform spatial audio processing, for example spatial filtering, on the beamformed stereo audio signal. Furthermore the spatial synthesizer 307 can be configured to output the processed audio signals in any suitable audio format. Thus for example the spatial synthesizer 307 can be configured to output a focused spatial audio signal 312 in selected audio format.

The spatial synthesizer 307 may be configured to process (for example adaptively mix) the beamformed stereo audio signal 306 and output these processed signals, for example as spherical harmonic audio signals to be rendered to a user.

The spatial synthesizer 307 may operate fully in the frequency domain or operate in partially in frequency band domain and partially in the time domain. For example the spatial synthesizer 307 may comprise a first or frequency band domain part which outputs a frequency band domain signal to an inverse filter bank and a second or time domain part which receives a time domain signal from the inverse filter bank and outputs suitable time domain audio signals. Furthermore in some embodiments the spatial synthesizer may be a linear synthesizer, an adaptive synthesizer or a hybrid synthesizer.

In such a manner the audio focus processing is divided into two parts. The beamforming part which is performed at the capture device and the spatial filtering part performed at the playback or rendering device. In such a manner audio content can be presented using a two (or other suitable number) number of audio channels complimented by metadata, the metadata including audio focus information as well as spatial information for spatial audio focus processing.

By dividing the audio focus operations into two parts the limitations performing all of the focus processing in the capture device may be overcome. For example in the embodiments as described above the playback format does not have to be selected when performing the capture operation as spatial synthesising and filtering and thus generating the rendered output format audio signals is performed at the playback device.

Similarly by applying spatial synthesising and filtering at the playback device support for inputs such as head tracking may be provided by the playback device.

Furthermore as the generation and encoding of a rendered multichannel audio signal to be output to the playback device is avoided a high bit rate output over the channel 309 is also avoided.

As well as these advantages there are also advantages in splitting the focus processing compared to the limitations of performing all of the focus processing in the playback device. For example either all of the microphone signals are required to be transmitted over the channel 309 which requires a high bitrate channel or only spatial filtering can be applied (or in other words no beam forming operation can be performed and thus the focus effect is not as strong).

The advantages of implementing a system such as shown in FIG. 3 may be for example that a user of the capture device can change the focus settings during the capture session, for example to remove or mitigate for a unpleasant noise source. In addition in some embodiments the user of the playback device can change focus settings or control parameters of the spatial filtering. A strong focus effect can be achieved when both processing stages focus on the same direction at the same time. In other words when the beam forming and spatial focusing is synchronised then a strong focus effect may be generated. The focus metadata can for example be transmitted to the playback device to enable the user of the playback device to synchronise the focus directions and thus make sure the strong focus effect can be generated.

Figure 4:
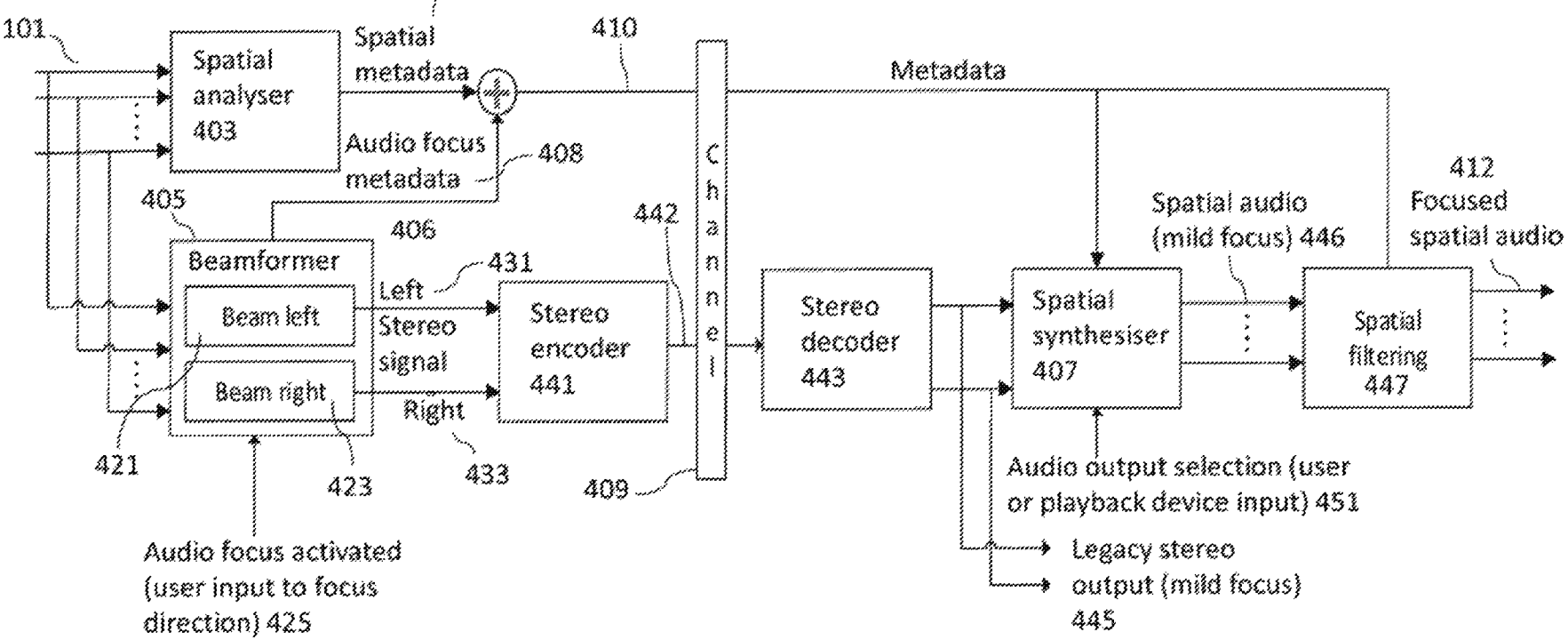
FIG. 4 shows schematically the example two stage audio focus system shown in FIG. 3 in further detail according to some embodiments.

With respect to FIG. 4 a further example implementation of the example two stage audio focus system implementing spatial audio format support shown in FIG. 3 is shown in further detail. In this example the system comprises a capture (and first stage processing) apparatus, a playback (and second stage processing) apparatus, and a suitable communications channel 409 separating the capture and playback apparatus.

In the example shown in FIG. 4 the microphone audio signals 101 are passed to the capture apparatus and specifically to the spatial analyser 403 and to the beamformer 405.

The capture apparatus spatial analyser 403 may be configured to receive the microphone audio signals and analyse the microphone audio signals to generate suitable spatial metadata 404 in a manner similar to that described above.

The capture apparatus beamformer 405 is configured to receive the microphone audio signals. The beamformer 405 in some embodiments is configured to receive an audio focus activation user input. The audio focus activation user input can in some embodiments define an audio focus direction. In the example shown in FIG. 4 the beamformer 405 is shown comprising a left beam former 421 which is configured to generate a left channel beamformed audio signal 431 and a right channel beamformer 423 configured to generate a right channel beamformed audio signal 433.

Furthermore the beamformer 405 is configured to output audio focus metadata 406.

The audio focus metadata 406 and the spatial metadata 404 can be combined to generate a combined metadata signal 410 which is stored or output over the channel 409.

The left channel beamformed audio signal 431 and the right channel beamformed audio signal 433 (from the beamformer 405) can be output to the stereo encoder 441.

The stereo encoder 441 can be configured to receive the left channel beamformed audio signal 431 and the right channel beamformed audio signal 433 and generate a suitable encoded stereo audio signal 442 which can be stored or output over the channel 409. The resulting stereo signal can been encoded using any suitable stereo codec.

The system, at the playback (second stage) apparatus side is configured to receive the combined metadata 410 and the encoded stereo audio signal 442. The playback (or receiver) apparatus comprises a stereo decoder 443 configured to receive the encoded stereo audio signal 442 and to decode the signal to generate suitable stereo audio signals 445. The stereo audio signals 445 in some embodiments can be output from the playback device where there is no spatial synthesiser or filter to provide legacy stereo output audio signals with a mild focus provided by the beamforming.

Furthermore the playback apparatus may comprises a spatial synthesiser 407 configured to receive the stereo audio output from the stereo decoder 443 and receive the combined metadata 410 and from these generate spatially synthesized audio signals in the correct output format. The spatial synthesiser 407 can thus generate a spatial audio signal 446 which has the mild focus produced by the beamformer 405. The spatial synthesizer 407 in some embodiments comprises an audio output format selection input 451. The audio output format selection input can be configured to control the playback apparatus spatial synthesiser 407 in generating the correct format output for the spatial audio signal 446. In some embodiments a defined or fixed format can be defined by the apparatus type, for example mobile phone, surround sound processor etc.

The playback apparatus further may comprise a spatial filter 447. The spatial filter 447 can be configured to receive the spatial audio output 446 from the spatial synthesiser 407 and the spatial metadata 410 and output a focused spatial audio signal 412. The spatial filter 447 can in some embodiments comprise a user input (not shown) such as from a head tracker which controls the spatial filtering operation of the spatial audio signal 446.

On the capture apparatus side the capture apparatus user can thus activate audio focus features and may have options for adjusting the strength or sector of the audio focus. On the capture/encoding side the focus processing is implemented using beamforming. Depending on the number of microphones different microphone pairs or arrangements may be utilised in beaming the left and right channel beamformed audio signals. For example with respect to FIGS. 5*a* and 5*b* are shown 3 and 4 microphone configurations.

Figure 5B:
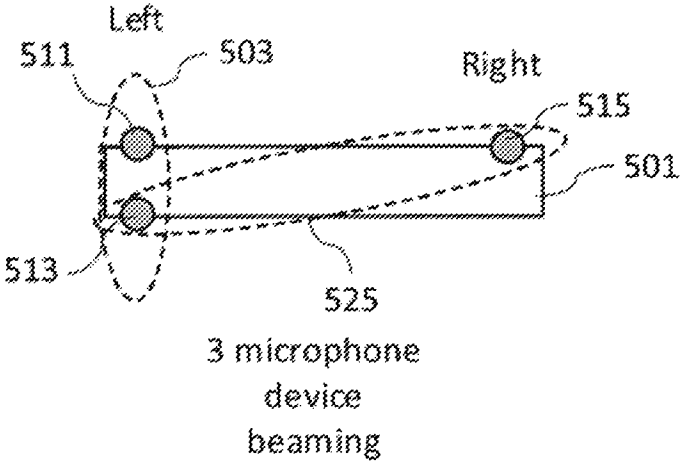
FIGS. 5*a* and 5*b* show schematically example microphone pair beamforming for implementing beamforming as shown in the systems shown in FIGS. 3 and 4 according to some embodiments.
Figure 5A:
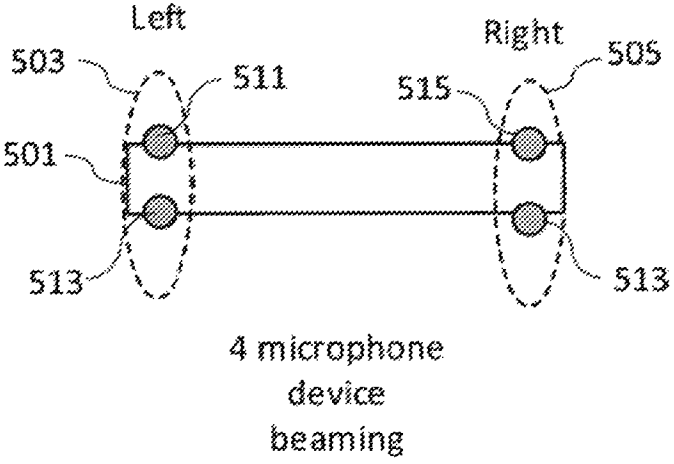

FIG. 5*a* for example shows a 4 microphone apparatus configuration. The capture apparatus 501 comprises front left microphone 511, front right microphone 515, rear left microphone 513 and rear right microphone 517. These microphones can be utilised in pairs such that the front left 511 and rear left 513 pair of microphones form the left beam 503 and the front right 515 and rear right 517 microphones form the right beam 505.

With respect to FIG. 5*b* a three microphone apparatus configuration is shown. In this example the apparatus 501 comprises front left microphone 511, front right microphone 515, and rear left microphone 513 only. The left beam 503 can be formed from the front left microphone 511 and the rear left microphone 513 and the right beam 525 can be formed from the rear left 513 and front right 515 microphones.

In some embodiments the audio focus metadata can be simplified. For example in some embodiments there is only one mode for front focus and another for back focus.

In some embodiments the spatial filtering in the playback apparatus (the second stage processing) may be used at least partly to cancel the focus effect of the beam forming (the first stage processing).

In some embodiments the spatial filtering can be used to filter only frequency bands which have not been (or not been sufficiently) processed by the beamforming in the first stage processing. This lack of processing during the beamforming may be due to the physical dimensions of the microphone arrangement not permitting a focus operation for certain defined frequency bands.

In some embodiments the audio focus operation may be an audio dampening operation wherein spatial sectors are processed so to remove a disturbing sound source.

In some embodiments a milder focus effect may be achieved by bypassing the spatial filtering part of the focus processing.

In some embodiments a different focus direction is used in beamforming and spatial filtering stages. For example the beamformer may be configured to beamform in a first focus direction defined by a direction a and the spatial filtering be configured to spatially focus the audio signals output from the beamformer in a second focus direction defined by a direction β.

In some embodiments the two-stage audio focus implementation can be implemented within the same device. For example where the capture apparatus for a first time (when recording a concert) is also the playback apparatus (at a later time when the user is at home reviewing the recording). In these embodiments the focus processing is implemented internally in 2 stages (and may be implemented at two separate times).

Figure 6:
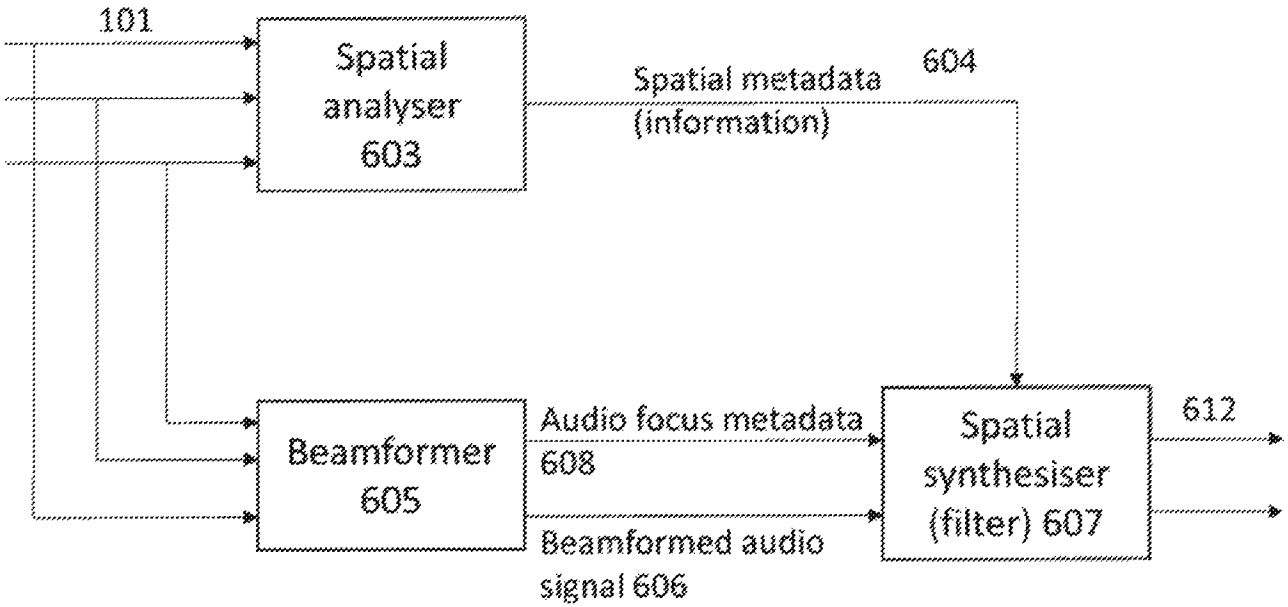
FIG. 6 shows a further example two stage audio focus system implemented within a single apparatus according to some embodiments.

For example such an example is shown with respect to FIG. 6. The single apparatus shown in FIG. 6 shows an example device system wherein the microphone audio signals 101 are passed to the spatial analyser 603 and to the beamformer 605. The spatial analyser 603 analyses the microphone audio signals in a manner as described above and generates spatial metadata (or spatial information) 604 which is passed directly to a spatial synthesiser 607. Furthermore the beamformer 605 is configured to receive the microphone audio signals from the microphones and output, generate beamformed audio signals and audio focus metadata 608 and pass this directly to the spatial synthesiser 607.

The spatial synthesizer 607 can be configured to receive the beamformed audio signals, audio focus metadata and the spatial metadata and generate a suitable focused spatial audio signal 612. The spatial synthesiser 607 may furthermore apply a spatial filtering to the audio signals.

Furthermore in some embodiments the operations of spatial filtering and spatial synthesizing may be changed such that the spatial filtering operation at the playback apparatus may occur before the generation of the spatial synthesis of the output format audio signals. With respect to FIG. 7 an alternate filter-synthesis arrangement is shown. In this example the system comprises a capture-playback apparatus, however the apparatus may be split into capture and playback apparatus separated by a communications channel.

Figure 7:
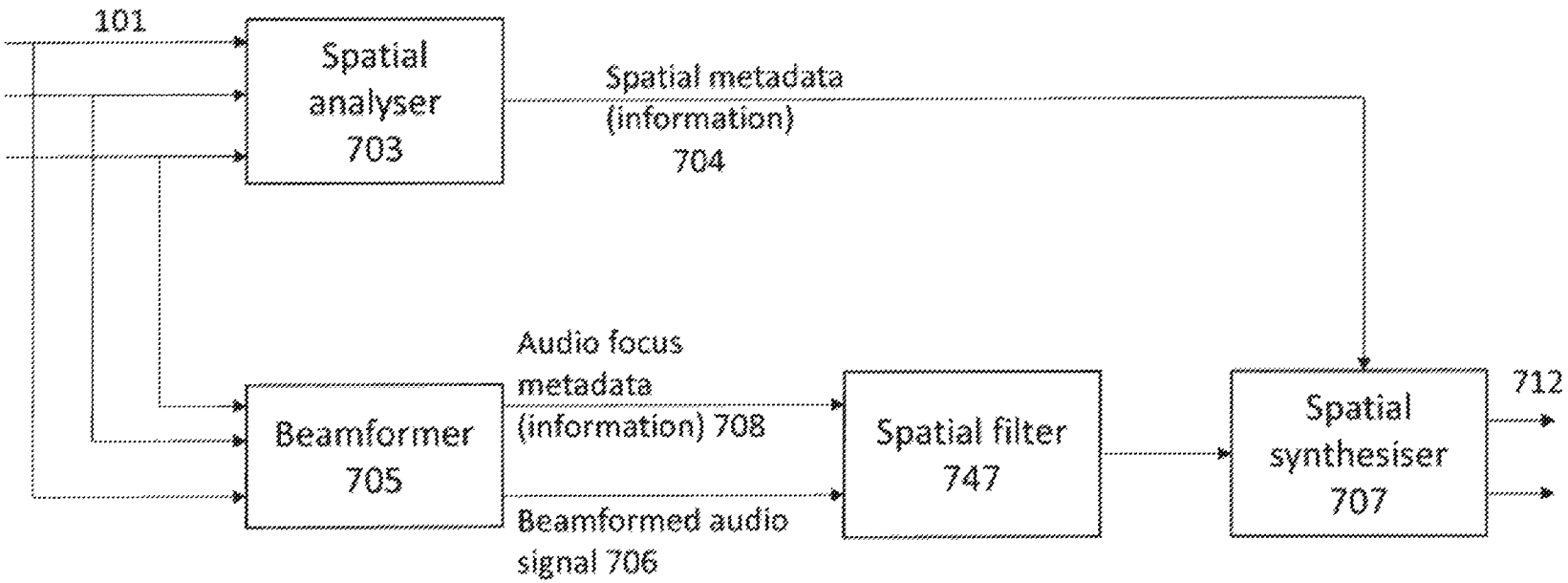
FIG. 7 shows a further example two stage audio focus system wherein spatial filtering is applied before spatial synthesis according to some embodiments.

In the example shown in FIG. 7 the microphone audio signals 101 are passed to the capture apparatus and specifically to the spatial analyser 703 and to the beamformer 705.

The capture-playback apparatus spatial analyser 703 may be configured to receive the microphone audio signals and analyse the microphone audio signals to generate suitable spatial metadata 704 in a manner similar to that described above. The spatial metadata 704 may be passed to the spatial synthesiser 707.

The capture apparatus beamformer 705 is configured to receive the microphone audio signals. In the example shown in FIG. 7 the beamformer 705 is shown generating a beamformed audio signal 706. Furthermore the beamformer 705 is configured to output audio focus metadata 708. The audio focus metadata 708 and the beamformed audio signal 706 can be output to a spatial filter 747.

The capture-playback apparatus further may comprise a spatial filter 747 configured to receive the beamformed audio signal and audio focus metadata and output a focused audio signal.

The focussed audio signal may be passed to a spatial synthesiser 707 configured to receive the focussed audio signal and receive the spatial metadata and from these generate spatially synthesized audio signals in the correct output format.

In some embodiments the two stage processing may be achieved within the playback apparatus. Thus for example with respect to FIG. 8 a further example is shown wherein the capture apparatus comprises a spatial analyser (and encoder) and the playback device comprise the beamformer and the spatial synthesizer. In this example the system comprises a capture apparatus, a playback (first and second stage processing) apparatus, and a suitable communications channel 809 separating the capture and playback apparatus.

Figure 8:
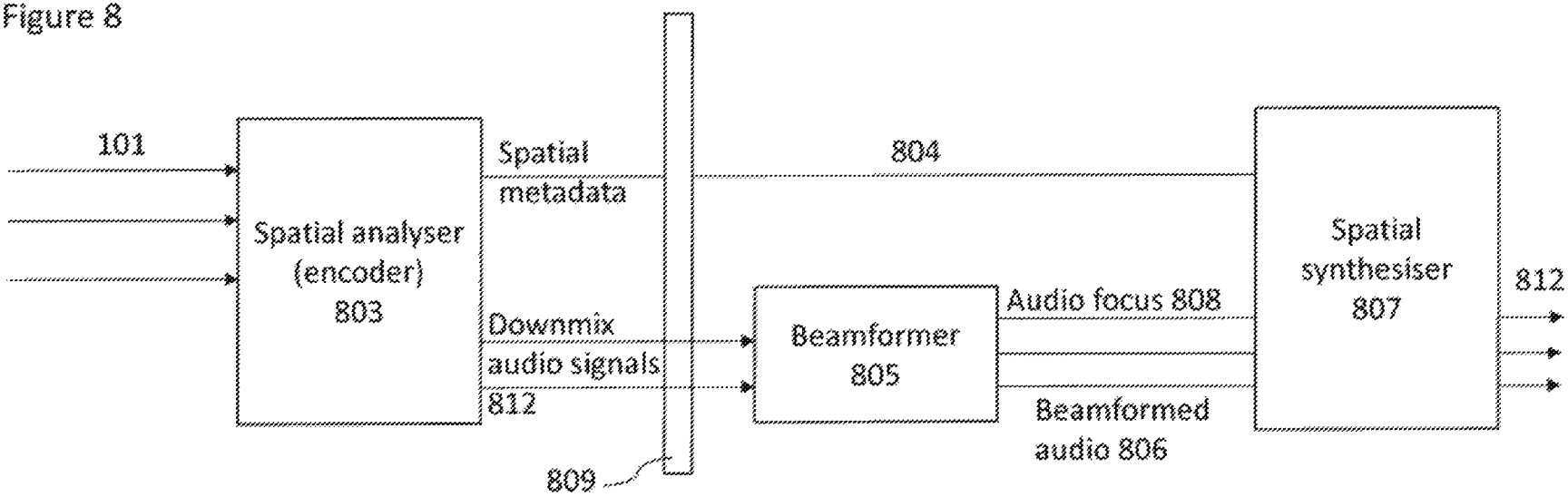
FIG. 8 shows an additional example two stage audio focus system wherein beamforming and spatial synthesis is implemented within an apparatus separate from the capture and spatial analysis of the audio signals.

In the example shown in FIG. 8 the microphone audio signals 101 are passed to the capture apparatus and specifically to the spatial analyser (and encoder) 803.

The capture apparatus spatial analyser 803 may be configured to receive the microphone audio signals and analyse the microphone audio signals to generate suitable spatial metadata 804 in a manner similar to that described above. Furthermore in some embodiments the spatial analyser may be configured to generate downmix channel audio signals and encode these to be transmitted along with the spatial metadata over the channel 809.

The playback apparatus may comprise a beamformer 805 configured to receive the downmix channel audio signals. The beamformer 805 is configured to generate a beamformed audio signal 806. Furthermore the beamformer 805 is configured to output audio focus metadata 808.

The audio focus metadata 808 and the spatial metadata 804 can be passed to the spatial synthesizer 807 along with the beamformed audio signal wherein the spatial synthesizer 807 is configured to generate a suitable spatially focussed synthesised audio signal output 812.

In some embodiments the spatial metadata may be analysed based on at least two microphone signals of a microphone array, and the spatial synthesis of the spherical harmonic signals may be performed based on the metadata and at least one microphone signal in the same array. For example, with a smartphone, all or some of the microphones could be used for the metadata analysis, and for example only the front microphone could be used for the synthesis of the spherical harmonic signals. However, it is understood that the microphones being used for the analysis may in some embodiments be different than the microphones being used for the synthesis. The microphones could also be a part of a different device. For example, it could be that the spatial metadata analysis is performed based on the microphone signals of a presence capture device with a cooling fan. Although the metadata is obtained, these microphone signals could be of low fidelity due to, by way of example, fan noise. In such a case, one or more microphones could be placed externally to the presence capture device. The signals from these external microphones could be processed according to the spatial metadata obtained using the microphone signals from the presence capture device.

There are various configurations that may be used to obtain the microphone signals.

It is also understood that any of the microphone signals discussed herein may be pre-processed microphone signals. For example, a microphone signal could be an adaptive or non-adaptive combination of actual microphone signals of a device. For example, there could be several microphone capsules nearby each other that are combined to provide a signal with an improved SNR.

The microphone signals could also be pre-processed, such as adaptively or non-adaptively equalized, or processed with noise-removal processes. Furthermore, the microphone signals may in some embodiments be beamform signals, in other words, spatial capture pattern signals that are obtained by combining two or more microphone signals.

It is thus understood that there are many configurations, devices, and approaches to obtain the microphone signals for the processing according to the methods provided herein.

In some embodiments, there may be only one microphone or audio signal, and the associated spatial metadata has been analysed previously. For example, it may be that after the analysis of the spatial metadata using at least two microphones the number of microphone signals has been reduced for transmission or storage, for example to only one channel. After the transmission, in such an example configuration, the decoder receives only one audio channel and the spatial metadata, and then performs the spatial synthesis of the spherical harmonic signals using the methods provided herein. Clearly, there could be also two or more transmitted audio signals, and the previously analysed metadata can also in such cases be applied at the adaptive synthesis of the spherical harmonic signals.

In some embodiments the spatial metadata is analyzed from at least two microphone signals, and the metadata along with at least one audio signal are transmitted to a remote receiver, or stored. In other words, the audio signals and the spatial metadata may be stored or transmitted in an intermediate format that is different than the spherical harmonic signal format. The format, for example, may feature lower bit rate than the spherical harmonic signal format. The at least one transmitted or stored audio signal can be based on the same microphone signals using which the spatial metadata was also obtained, or based on signals from other microphones in the sound field. At a decoder, the intermediate format may be transcoded into a spherical harmonic signal format, thus enabling the compatibility with services such as YouTube. In other words, at a receiver or a decoder, the transmitted or stored at least one audio channel is processed to a spherical harmonic audio signal representation utilizing the associated spatial metadata and using the methods described herein. While transmitted or stored, in some embodiments the audio signal(s) may be encoded, for example, using AAC. In some embodiments the spatial metadata may be quantized, encoded and/or embedded to the AAC bit stream. In some embodiments the AAC or otherwise encoded audio signals and the spatial metadata may be embedded into a container such as the MP4 media container. In some embodiments the media container, being for example MP4, may include a video stream, such as an encoded spherical panoramic video stream. Many other configurations to transmit or store the audio signals and the associated spatial metadata exist.

Figure 9:
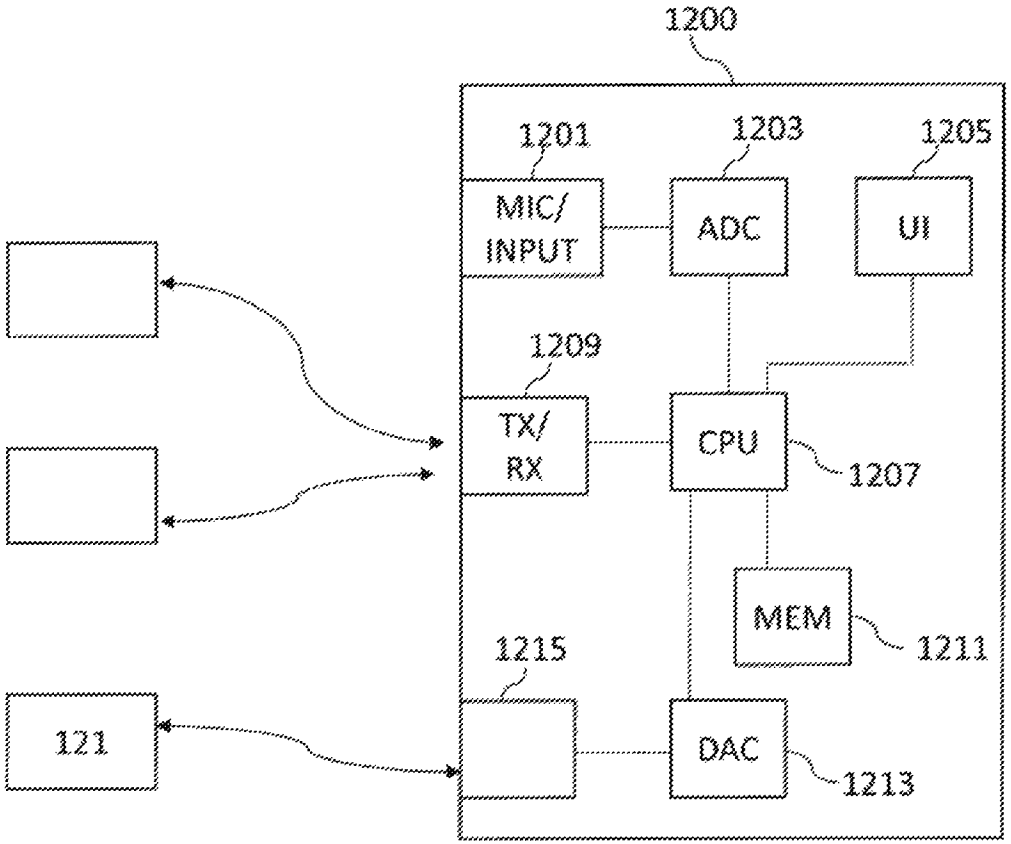
FIG. 9 shows an example apparatus suitable for implementing the two stage audio focus system as shown in any of the FIGS. 3 to 8.

Regardless of the applied methods to transmit or store the audio signals and the spatial metadata, at the receiver (or decoder or processor) the methods described herein provide the means to generate the spherical harmonic signals adaptively based on the spatial metadata and at least one audio signal. In other words, for the methods presented herein, it is in practice not relevant if the audio signals and/or the spatial metadata are obtained from the microphone signals directly, or indirectly, for example, through encoding, transmission/storing and decoding. With respect to FIG. 9 an example electronic device 1200 which may be used as at least part of the capture and/or playback apparatus is shown. The device may be any suitable electronics device or apparatus. For example in some embodiments the device 1200 is a virtual or augmented reality capture device, a mobile device, user equipment, tablet computer, computer, audio playback apparatus, etc.

The device 1200 may comprise a microphone array 1201. The microphone array 1201 may comprise a plurality (for example a number M) of microphones. However it is understood that there may be any suitable configuration of microphones and any suitable number of microphones. In some embodiments the microphone array 1201 is separate from the apparatus and the audio signals transmitted to the apparatus by a wired or wireless coupling.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC analysis, beamforming, spatial synthesis and spatial filtering such as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

The transceiver 1209 can communicate with further apparatus by any suitable known communications protocol. For example in some embodiments the transceiver 1209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as a synthesizer apparatus. As such the transceiver 1209 may be configured to receive the audio signals and determine the spatial metadata such as position information and ratios, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Furthermore the device 1200 can comprise in some embodiments an audio subsystem output 1215. An example, such as shown in FIG. 6, may be where the audio subsystem output 1215 is an output socket configured to enabling a coupling with headphones 121. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that in some embodiments the device 1200 can comprise just the audio capture or audio render apparatus elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the electronic device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving at least two microphone audio signals for audio signal processing wherein the audio signal processing comprises at least a spatial audio signal processing for outputting spatial information and a beamforming processing for outputting focus information and at least one beamformed audio signal;

determining the spatial information based on the spatial audio signal processing associated with the at least two microphone audio signals;

determining the focus information and the at least one beamformed audio signal for the beamforming processing associated with the at least two microphone audio signals; and applying a spatial filter to the at least one beamformed audio signal in order to spatially synthesize at least one focused spatially processed audio signal based on the at least one beamformed audio signal, the spatial information and the focus information in such a way that the spatial filter, the at least one beamformed audio signal, the spatial information and the focus information are used for spatially synthesizing the at least one focused spatially processed audio signal.

2. The method as claimed in claim 1, further comprising generating a combined metadata signal from the spatial information and the focus information.

3. The method as claimed in claim 1, wherein the spatial information comprises a frequency band indicator for determining which frequency bands of the at least one spatial audio signal are processed by the beamforming processing.

4. The method as claimed in claim 1, wherein outputting the at least one beamformed audio signal from the beamforming processing comprises at least one of:

producing at least two beamformed stereo audio signals;

determining one of two predetermined beamform directions; and beamforming the at least two microphone audio signals in the one of the two predetermined beamform directions.

5. The method as claimed in claim 1, further comprising receiving the at least two microphone audio signals from a microphone array.

6. A method comprising:

spatially synthesizing at least one spatial audio signal from at least one beamformed audio signal and spatial metadata information, wherein the at least one beamformed audio signal is generated from a beamforming processing associated with at least two microphone audio signals and the spatial metadata information is based on audio signal processing associated with the at least two microphone audio signals; and spatially filtering the at least one spatial audio signal based on focus information for the beamforming processing to provide at least one focused spatially processed audio signal.

7. The method as claimed in claim 6, further comprising:

spatial audio signal processing the at least two microphone audio signals to determine the spatial metadata information; and determining the focus information for the beamforming processing and beamforming processing the at least two microphone audio signals for producing the at least one beamformed audio signal.

8. The method as claimed in claim 6, further comprising receiving an audio output selection indicator defining an output channel arrangement and spatially synthesizing the at least one spatial audio signal is further comprising generating the at least one spatial audio signal in a format based on the audio output selection indicator.

9. The method as claimed in claim 6, further comprising receiving an audio filter selection indicator defining a spatial filtering and spatially filtering the at least one spatial audio signal based on at least one focus filter parameter associated with the audio filter selection indicator, wherein the at least one focus filter parameter comprises at least one of:

at least one spatial focus filter parameter, the spatial focus filter parameter defining at least one of a focus direction in at least one of azimuth and/or elevation and a focus sector in a azimuth width and/or elevation height;

at least one frequency focus filter parameter, the frequency focus filter parameter defining at least one frequency band of which the at least one spatial audio signal is focused;

at least one dampening focus filter parameter, the dampening focus filter parameter defining a strength of a dampening focus effect on the at least one spatial audio signal;

at least one gain focus filter parameter, the gain focus filter parameter defining a strength of a focus effect on the at least one spatial audio signal; and a focus bypass filter parameter, the focus bypass filter parameter defining whether to implement or bypass the spatial filter of the at least one spatial audio signal.

10. The method as claimed in claim 9, wherein the audio filter selection indicator is provided from a head tracker input.

11. The method as claimed in claim 9, wherein the focus information comprises a steering mode indicator for enabling the processing of the audio filter selection indicator provided from the head tracker input.

12. The method as claimed in claim 6, further comprising spatially filtering the at least one spatial audio signal at least in part to cancel an effect of the beamforming processing.

13. The method as claimed in claim 6, wherein spatially filtering the at least one spatial audio signal comprises spatially filtering at least one of:

frequency bands that are not significantly affected by the beamforming processing associated with at least two microphone audio signals; and the at least one spatial audio signal in a direction indicated within the focus information.

14. An apparatus comprising one or more processors configured to:

receive at least two microphone audio signals for audio signal processing wherein the audio signal processing comprises at least a spatial audio signal processing to output spatial information and a beamforming processing to output focus information and at least one beamformed audio signal;

determine the spatial information based on the spatial audio signal processing associated with the at least two microphone audio signals;

determine the focus information and the at least one beamformed audio signal for the beamforming processing associated with the at least two microphone audio signals; and apply a spatial filter to the at least one beamformed audio signal in order to spatially synthesize at least one focused spatially processed audio signal based on the at least one beamformed audio signal, the spatial information and the focus information in such a way that the spatial filter, the at least one beamformed audio signal, the spatial information and the focus information are configured to spatially synthesize the at least one focused spatially processed audio signal.

15. The apparatus as claimed in claim 14, further comprising generating a combined metadata signal from the spatial information and the focus information.

16. The apparatus as claimed in claim 14, wherein the spatial information comprises a frequency band indicator to determine which frequency bands of the at least one spatial audio signal are processed by the beamforming processing.

17. The apparatus as claimed in claim 14, wherein the apparatus configured to output the at least one beamformed audio signal is further configured to at least one of:

produce at least two beamformed stereo audio signals;

determine one of two predetermined beamform directions; and beamform the at least two microphone audio signals in the one of the two predetermined beamform directions.

18. An apparatus comprising one or more processors configured to:

spatially synthesize at least one spatial audio signal from at least one beamformed audio signal and spatial metadata information, wherein the at least one beamformed audio signal is generated from a beamforming processing associated with at least two microphone audio signals and the spatial metadata information is based on audio signal processing associated with the at least two microphone audio signals; and spatially filter the at least one spatial audio signal based on focus information for the beamforming processing to provide at least one focused spatially processed audio signal.

19. The apparatus as claimed in claim 18, further configured to:

spatial audio signal process the at least two microphone audio signals to determine the spatial metadata information; and determine the focus information for the beamforming processing and beamforming process the at least two microphone audio signals for producing the at least one beamformed audio signal.

20. The apparatus as claimed in claim 18, further configured to receive an audio output selection indicator to define an output channel arrangement and spatially synthesize the at least one spatial audio signal to generate the at least one spatial audio signal in a format based on the audio output selection indicator.

* * * * *